US006664222B1

(12) United States Patent
Cao et al.

(10) Patent No.: US 6,664,222 B1
(45) Date of Patent: Dec. 16, 2003

(54) WASH CYCLE UNIT DOSE SOFTENER

(75) Inventors: Hoai-Chau Cao, Ans (BE); Alain Gourgue, Lincent (BE); Alain Jacques, Blegny (BE); Joseph Reul, Heusy (BE); Juliette Rousselet, Bassenge (BE); Jeffrey T. Epp, Mt. Arlington, NJ (US); Amjad Farooq, Hillsborough, NJ (US); Charles J. Schramm, Jr., Hillsborough, NJ (US)

(73) Assignee: Colgate-Palmolive Co., New York, NY (US)

( * ) Notice: Subject to any disclaimer, the term of this patent is extended or adjusted under 35 U.S.C. 154(b) by 0 days.

(21) Appl. No.: 10/064,124

(22) Filed: Jun. 13, 2002

(51) Int. Cl.[7] ..... C11D 17/00

(52) U.S. Cl. ..... 510/298; 510/439; 510/446; 510/507; 510/515

(58) Field of Search ..... 510/515, 507, 510/439, 446, 298

(56) References Cited

U.S. PATENT DOCUMENTS 4,025,444 A * 5/1977 Murphy et al. ..... 510/332
4,569,773 A 2/1986 Ramachandran et al. .... 252/8.7
4,605,506 A 8/1986 Wixon ..... 252/8.75
4,818,421 A 4/1989 Boris et al. ..... 252/8.8
4,851,138 A 7/1989 Jaroschek et al. ..... 252/88
5,225,100 A 7/1993 Fry et al. ..... 252/174.25
5,360,567 A * 11/1994 Fry et al. ..... 510/298
5,972,870 A 10/1999 Anderson ..... 510/298
6,258,767 B1 7/2001 Jacques et al. ..... 510/298
6,291,421 B1 9/2001 Jacques et al. ..... 510/515
6,294,516 B1 9/2001 Jacques et al. ..... 510/515
6,306,814 B1 * 10/2001 Appel et al. ..... 510/446

* cited by examiner

*Primary Examiner*—John Hardee
(74) *Attorney, Agent, or Firm*—Bernard Lieberman

(57) ABSTRACT

A unit dose wash cycle fabric softening composition for softening or conditioning fabrics in the wash cycle of an automatic washing machine, said unit dose comprising a compacted granular fabric softener composition comprising a softening clay component in an amount sufficient to form a unit dose capable of providing effective softening or conditioning of fabrics in the wash cycle of said washing machine.

20 Claims, No Drawings

WASH CYCLE UNIT DOSE SOFTENER

BACKGROUND OF INVENTION

1. Field of the Invention

This invention relates to wash cycle unit dose laundry compositions for softening or conditioning fabrics. More particularly, this invention relates to unit dose fabric softening compositions which are compacted granular compositions suitable for use in the wash cycle of an automatic washing machine.

2. Background of the Invention

Detergent compositions manufactured in the form of compacted detergent powder are known in the art. U.S. 5,225,100, for example, describes a tablet of compacted powder comprising an anionic detergent compound which will adequately disperse in the wash water.

U.S. Pat. Nos. 6,258,767; 6,294,516 and 6,291,421 assigned to Colgate-Palmolive Company describe unit dose granular and encapsulated liquid fabric softening compositions suitable for use as an additive to the wash cycle of a washing machine, or during hand washing of laundry.

Another possible option for providing a unit dose softener apart from the wash cycle is to introduce the softening ingredients directly into the rinse cycle. But, for this type of product to be effective several practical requirements must be met. To begin with, the size and shape of the unit dose container must be readily compatible with the geometry of a wide variety of rinse cycle dispensers designed for home washing machines in order to insure its easy introduction into the dispenser. Moreover, in common with the general use of rinse cycle softeners, it is necessary to clean the rinse dispenser on a regular basis to avoid residue from accumulating within the dispenser or even, at times, prevent bacterial growth from occurring.

Still further, a unit dose composition for the rinse cycle must be formulated to readily dispense its contents upon contact with water in a period of time corresponding to the residence time of the unit dose in the dispenser, namely, the period of time during which water enters and flows through the rinse cycle dispenser. The aforementioned practical requirements have to date not been successfully met with any commercially available product and hence there remains a need in the art for a unit dose softener capable of activation in the rinse cycle.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No 4,818,421 to Boris et al. and U.S. Pat. No. 4,569,773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water.

It has now been found that softening of laundry can be effected in the wash cycle with a flexibility which is independent of the detergent dosage, and with great convenience by the consumer by the use of a compacted granular unit dose wash cycle softener which avoids the common problems associated with the pouring and handling of granular or liquid detergent compositions, and which provides enhanced dispersibility of the compacted granular composition in the wash water.

SUMMARY OF INVENTION

There is provided herein a unit dose wash cycle fabric softening composition for softening or conditioning fabrics which is readily dispersible during hand wash or in the wash cycle of an automatic washing machine, and which substantially avoids the deposition of residue on the washed fabrics, said unit dose comprising a compacted granular fabric softener composition comprising a softening clay component in an amount sufficient to form a unit dose capable of providing effective softening or conditioning of fabrics in the wash cycle, and wherein said compacted fabric softener composition is formed from granules of softener, which granules are formed from a powder of said clay component wherein at least 90% of the particles of said powder are below about 200 microns in size.

In a preferred embodiment the unit dose fabric softening composition is characterized by being in the form of a tablet and having no discrete outer layer surrounding the fabric softener comprised of an alkaline material such that the pH of the wash water is increased upon dissolution of said outer layer in said wash water.

The particles of powder of the softening clay component used to form the aforementioned granules of softener are preferably at least 90% and more preferably at least 95% below about 200 microns in size or alternatively about 150 microns in size and most preferably, at least 90% and even more preferably at least 95% below about 53 microns in size. Avoiding the deposition of residue on the washed fabrics in accordance with the invention is predicated on the use of particle sizes of the softening clay component as described herein.

In accordance with the process aspect of the invention there is provided a process for softening or conditioning laundry which comprises contacting the laundry with an effective amount of the unit dose laundry composition defined above.

DETAILED DESCRIPTION

The clays that are useful components of the invented products include the montmorillonite-containing clays which have swelling properties (in water) and which are of smectite structure, so that they deposit on fibrous materials, especially cotton and cotton/synthetic blends, such as cotton/polyester, to give such fibers and fabrics made from them a surface lubricity or softness. The best of the smectite clays for use in the present invention is bentonite and the best of the bentonites are those which have a substantial swelling capability in water, such as the sodium and potassium bentonites. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, it has been found that such non-swelling bentonites exhibit even better fabric softening in combination with PEC's than do the swelling bentonites, provided that there is present in the softening composition, a source of alkali metal or other solubilizing ion, such as sodium (which may come from sodium hydroxide, added to the composition, or from sodium salts, such as builders and fillers, which may be functional components of the composition). Among the preferred bentonites are those of sodium and potassium, which are normally swelling, and calcium and magnesium, which are normally non-swelling. Of these it is preferred to utilize calcium (with a source of sodium being present) and sodium bentonites. The bentonites employed may be produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. The bentonite and other such suitable swellable clays may be agglomerated to larger particle sizes too, such as 60 to 120 sieves, but such agglomerates are not preferred unless they include the PEC('s) too (in any particulate products).

In a preferred embodiment of the invented compositions and articles of the present invention, there is included in combination with the fabric softening clay, an organic fatty softener to provide enhanced softening of laundry. The organic softener can be anionic, cationic or nonionic fatty chains ($C_{10}$–$C_{22}$ preferably $C_{12}$–$C_{18}$). Anionic softeners include fatty acids soaps. Preferred organic softeners are nonionics such as fatty esters, ethoxylated fatty esters, fatty alcohols and polyols polymers. The organic softener is most preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound is often abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds are preferably partial esters. And more preferably there will be at least two free hydroxyls thereon after esterification (on the pentaerythritol, oligomer or alkoxyalkane groups). Frequently, the number of such free hydroxyls is two or about two but sometimes it may by one, as in pentaerythritol tristearate. The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as tallow or coconut oil, or from such natural materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of some esters (PEC's) within the present invention follow:

Monopentaerythritol Esters

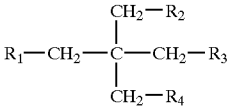

Monopentaerythritol Dilaurate $R_1$=$CH_3$—$(CH_2)_{10}$—COO—

$R_2$=$CH_3$—$(CH_2)_{10}$—COO—

$R_3$=OH $R_4$=OH

Monopentaerythritol Monostearate $R_1$=$CH_3$—$(CH_2)_{16}$—COO—

$R_2$=OH $R_3$=OH $R_4$=OH

Monopentaerythritol Distearate $R_1$=$CH_3$—$(CH_2)_{16}$—COO—

$R_2$=$CH_3$—$(CH_2)_{16}$—COO—

$R_3$=OH $R_4$=OH

Monopentaerythritol Tristearate $R_1$=$CH_3$—$(CH_2)_{16}$—COO—

$R_2$=$CH_3$—$(CH_2)_{16}$—COO—

$R_3$=$CH_3$—$(CH_2)_{16}$—COO—

$R_4$=OH

Monopentaerythritol Monobehenate $R_1$=$CH_3$—$(CH_2)_{20}$—COO—

$R_2$=OH $R_3$=OH $R_4$=OH

Monopentaerythritol Dibehenate $R_1$=$CH_3$—$(CH_2)_{20}$—COO—

$R_2$=$CH_3$—$(CH_2)_{20}$—COO—
$R_3$=OH
$R_4$=OH
Dipentaerythritol Esters

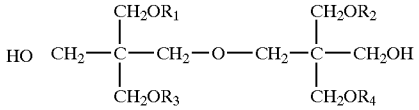

Dipentaerythritol Tetralaurate
$R_1$=$CH_3$—$(CH_2)_{10}$—CO
$R_2$=$CH_3$—$(CH_2)_{10}$—CO
$R_3$=$CH_3$—$(CH_2)_{10}$—CO
$R_4$=$CH_3$—$(CH_2)_{10}$—CO
Dipentaerythritol Tetrastearate
$R_1$=$CH_3$—$(CH_2)_{16}$—CO
$R_2$=$CH_3$—$(CH_2)_{16}$—CO
$R_3$=$CH_3$—$(CH_2)_{16}$—CO
$R_4$=$CH_3$—$(CH_2)_{16}$—CO
Pentaerythritol 10 Ethylene Oxide Ester

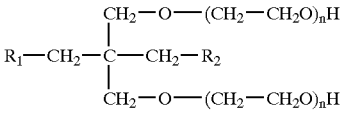

with n + n′ = 10

Monopentaerythritol 10 Ethylene Oxide Distearate
$R_1$=$CH_3$—$(CH_2)_{16}$—COO—
$R_2$=$CH_3$—$(CH_2)_{16}$—COO—
Pentaerythritol 4 Propylene Oxide Esters

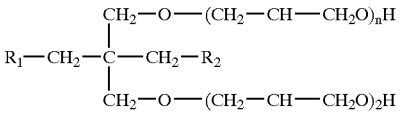

Monopentaerythritol 4 Propylene Oxide Monostearate
$R_1$=$CH_3$—$(CH_2)_{16}$—COO—
$R_2$=OH
Monopentaerythritol 4 Propylene Oxide Distearate
$R_1$=$CH_3$—$(CH_2)_{16}$—COO—
$R_2$=$CH_3$—$(CH_2)_{16}$—COO—

Although in the formulas given herein some preferred pentaerythritol compounds that are useful in the practice of this invention are illustrated it will be understood that various other such pentaerythritol compounds within the description thereof may also be employed herein, including such as pentaerythritol dihydrogenated tallowate, pentaerythritol ditallowate, pentaerythritol dipalmitate, and dipentaerythritol tetratallowate.

To enhance the softening efficacy of the unit dose compositions described herein cationic softeners such as conventional quaternary ammonium softening compounds may optionally be added in minor amounts.

The combination of bentonite and organic fatty softening material is generally from about 10% to about 100% bentonite and from about 1% to about 100% fatty softening material, preferably from about 50% to about 95% bentonite and about 5% to about 50% fatty softening material, and most preferably from about 80% to 90% bentonite and from about 10% to about 20% fatty softening material.

Other useful ingredients for the unit dose compacted granular compositions of the invention include disintegration materials to enhance the disintegration of the unit dose in the wash water. Such materials include an effervescent matrix such as citric acid combined with baking soda, or materials such as PVP polymer and cellulose. Granulating agents may be used such as polyethylene glycol; bactericides, perfumes, dyes and materials to protect against color fading, dye transfer, anti-pilling and anti-shrinkage. For purposes of enhancing the aesthetic properties of the final composition, cosmetic ingredients such as dyes, micas and waxes may be used as coating ingredients to improve the appearance and feel of the unit dose.

Clay/PDT granules and tablets are conveniently made following five major steps:a) PDT oversprayed onto Clay powder; b)Agglomeration of Clay PDT powder to make granules; c)Fragrances and color dyes addition to Clay PDT granules; d)Blending with powder disintegration system to form a particulate composition; e)Compaction into tablets The agglomeration step is designed to form granules. Both batch and continuous granulation equipment is suitable for the task. A drying step is usually employed to condition the granules. Rotary or fluid bed dryers are examples of suitable drying/conditioning equipment.

Fragrances and color dye solutions are then applied to the clay PDT granules. Preferred mixing devices include both batch and continuous rotary mixers (ie rotary drums, twin shell mixers).

To prepare the product for tableting, the powder disintegration system is blended to the clay PDT granules using both continuous and batch mixing systems, with the preferred ones having minimum shear on the granules.

The blended granules are finally compacted into tablets using alternative or high speed rotative presses. Ideal tableting conditions balance tablet hardness which promotes consumer preferred disintegration and durability to survive the shipping process.

EXAMPLE 1

A compacted granular unit dose composition was prepared from the following ingredients:

| | Weight Percent |
|---|---|
| Clay/Pentaerythritol ditallowate (PDT) in a ratio of 83%:17% | 79.97% |
| Effervescent matrix of baking soda and citric acid | 17% |
| Polyvinylpyrrolidone | 1% |
| Perfume | 2% |
| Dye | 0.03% |

The method of manufacture was as described above. The weight of the spherical unit dose was 60 g and such unit dose dispersed in water within 20 minutes when introduced in the wash load at the beginning of the wash in a European Miele W832 front loading washing machine set a Program White Colors at 40° C.

The softness provided by the unit dose compositions on terry towels, cotton tee-shirts and cotton kitchen towels was evaluated after cumulative washes and compared with a commercial liquid fabric softener. A 3 Kg laundry ballast was used in the machine. Softness was evaluated by a panel of six judges using 9 replicates. The results were as follows:

| SOFTNESS EVALUATION | |
|---|---|
| Laundry Item | Softness Comparison |
| Terry towels | 1 unit dose softener composition of the invention provided equivalent softness to commercial liquid FS after 10 cumulative wash cycles |
| Cotton tee-shirts | 1 unit dose softener provided equivalent softness to commercial liquid PS after one wash cycle |
| Cotton kitchen towels | 1 unit dose softener provided enhanced softening relative to commercial liquid FS after one wash cycle |

EXAMPLE 2

Two Clay/PDT (same ratio as in Example 1) granules were made by granulation of powder having different particle sizes.

Granule 1 was clay granules formed from powder having 31% of its particle size above 150 microns; and Granule 2 was clay granules formed from powder containing only a very low level (2%) of particles above 150 microns in size.

TABLE 1

Clay/PDT Powder Composition

| Particle size distribution of Clay/PDT powder used for granulation | Powder 1 | Powder 2 |
|---|---|---|
| Particles above 150 microns (%) | 31 | 2 |
| Particles below 150 microns (%) | 69 | 98 |
| Granulation | Granule 1 | Granule 2 |

Tablets were then successively made with these two Granules 1 and 2 together with the following ingredients:

TABLE 2

Compacted Tablet Composition

| | Tablet 1 | Tablet 2 |
|---|---|---|
| Clay/PDT Granule 1 | 80.0 | — |
| Clay/PDT Granule 2 | — | 80.0 |
| Disintegrating agent | 15.7 | 15.7 |
| Perfume | 4.3 | 4.3 |
| Tablet weight | 19 gr | 19 gr |

Washing tests were carried in automatic machine with dark laundry fabrics to determine the dispersion behavior of both the clay granules and the tablets in water.

After the complete wash and rinse cycles, dark laundry fabrics were carefully flat dried overnight, and visual evaluations were carried out with trained panelists to evaluate the residues left on the fabrics.

A 6 scale rating system was used to measure the visual evaluations.

A Rating of 1 indicates that absolutely no residues were observed.

A Rating of 6 indicates that large amounts of very visible residues were observed.

The results of the washing test are shown below in Table 3.

A rating or evaluation score of less than 3 is generally required for an acceptable commerical product.

TABLE 3

Residue evaluations after washing test

| Test Product | Evaluation Scores |
|---|---|
| Granule 1 | 5.1 |
| Granule 2 | 2.0 |
| Tablet 1 | 5.0 |
| Tablet 2 | 2.2 |

Based on the data of Table 3, it was clearly evidenced that both Granule 2 and Tablet 2 which were made from clay/PDT powder in accordance with the invention manifested significantly less residues on dark fabrics after the washing step than Granule 1 and Tablet 1.

What is claimed is:

1. A unit dose wash cycle fabric softening composition for softening or conditioning fabrics which is readily dispersible during hand wash or in the wash cycle of an automatic washing machine, and which substantially avoids the deposition of residue on the washed fabrics, said unit dose comprising a compacted granular fabric softener composition comprising a softening clay component in an amount sufficient to form a unit dose capable of providing effective softening or conditioning of fabrics in the wash cycle, and wherein said compacted fabric softener composition is formed from granules of softener, which granules are formed from a powder of said clay component wherein at least 90% of the particles of said powder are below about 200 microns in size and wherein the softening composition further comprises a liquid fatty ester, wherein said fatty ester is sunflower oil; or wherein the softening composition further comprises a liquid silicone; or wherein the softening composition further comprises a fatty alcohol, said fatty alcohol being oleyl alcohol.

2. A unit dose softening composition as in claim 1 characterized by being in the form of a tablet and having no discrete outer layer surrounding the fabric softener comprised of an alkaline material such that the pH of the wash water is increased upon the dissolution of said outer layer in said wash water.

3. A unit dose softening composition as in claim 1 wherein at least 90% of said particles of powder are below about 150 microns in size.

4. A unit dose softening composition as in claim 1 wherein at least 90% of said particles of powder are below about 53 microns in size.

5. A unit dose softening composition as in claim 1 wherein said softening clay component comprises a softening clay in combination with an organic fatty softening material.

6. A unit dose softening composition as in claim 5 wherein said softening clay is a montmorillonite-containing clay and said organic fatty softening material is a pentaerythritol compound (PEC) selected from the group consisting of a higher aliphatic acid ester of pentaerythritol, an oligomer of pentaerythritol, a lower alkylene oxide derivative of an oligomer of pentaerythritol, and a mixture thereof.

7. A unit dose softening composition as in claim 5 wherein said softening clay is a montmorillonitecontaining clay and said organic fatty softening material is a fatty alcohol.

8. A unit dose softening composition as in claim 5 wherein said softening clay is at least partially coated with said organic fatty softening material and serves as a carrier for such fatty softening material.

9. A unit dose softening composition as in claim 6 wherein said softening clay is bentonite and said PEC is a higher aliphatic ester of pentaerythritol or of an oligomer of pentaerythritol.

10. A unit dose softening composition as in claim 6 wherein the combination of clay and fatty softening material comprises, by weight, from about 50% to about 95% of bentonite and from about 5% to about 50% of said PEC.

11. A unit dose softening composition as in claim 10 wherein said combination of clay and fatty softening material comprises from about 80 to about 90% of bentonite and from about 10% to about 20% of said PEC.

12. A unit dose softening composition as in claim 1 wherein said fabric softener further includes sunflower oil.

13. A unit dose softening composition as in claim 1 wherein said fabric softener composition further includes a liquid silicone.

14. A unit dose softening composition as in claim 1 wherein said fabric softener composition further includes a liquid oleyl alcohol.

15. A process for softening or conditioning laundry which comprises contacting the laundry with an effective amount of the unit dose softening composition of claim 1.

16. A process according to claim 15 wherein said softening clay component comprises a softening clay in combination with an organic fatty softening material.

17. A process according to claim 16 wherein said softening clay is bentonite and said organic softening material comprises a fatty alcohol or pentaerythritol compound (PEC) selected from the group consisting of a higher aliphatic acid ester of pentaerythritol, an oligomer of pentaerythritol, a lower alkylene oxide derivative of an oligomer of pentaerythritol, and a mixture thereof.

18. A process according to claim 15 wherein at least 90% of said particles of powder are below about 150 microns in size.

19. A process according to claim 15 wherein at least 90% of said particles of powder are below about 53 microns in size.

20. A process according to claim 15 wherein said fabric softener further includes a liquid fatty ester.

* * * * *